United States Patent [19]

Panchanathan et al.

[11] 4,395,464

[45] Jul. 26, 1983

[54] COPPER BASE ALLOYS MADE USING RAPIDLY SOLIDIFIED POWDERS AND METHOD

[75] Inventors: Viswanathan Panchanathan, Billerica; Ranjan Ray, Waltham; Bill C. Giessen, Cambridge, all of Mass.

[73] Assignee: Marko Materials, Inc., No. Billerica, Mass.

[21] Appl. No.: 249,926

[22] Filed: Apr. 1, 1981

[51] Int. Cl.[3] ..... C22C 9/06; B22F 7/00; B22F 9/00

[52] U.S. Cl. ..... 428/546; 419/12; 419/48; 420/486

[58] Field of Search ..... 148/32, 32.5; 75/153, 75/159; 420/486; 428/564; 419/12, 48

[56] References Cited

U.S. PATENT DOCUMENTS 3,293,029 12/1966 Broderick et al. ..... 75/159

FOREIGN PATENT DOCUMENTS 54-112324 9/1979 Japan ..... 75/159

*Primary Examiner*—Peter K. Skiff

*Attorney, Agent, or Firm*—Morse, Altman & Dacey

[57] ABSTRACT

New copper-rich metal alloys containing nickel along with certain specific amounts of boron are disclosed. The alloys are subjected to a rapid solidification processing (RSP) technique which produces cooling rates between $\sim 10^5$ to $10^{7\circ}$ C./sec. The asquenched ribbon, powder, etc. consists primarily of a metastable crystalline solid solution phase. The metastable crystalline phases are subjected to suitable heat treatments so as to produce a transformation to a stable multiphase microstructure, which includes borides. This heat treated alloy exhibits superior mechanical properties with good corrosion and/or oxidation resistance for numerous engineering applications.

5 Claims, No Drawings

COPPER BASE ALLOYS MADE USING RAPIDLY SOLIDIFIED POWDERS AND METHOD

BACKGROUND OF THE INVENTION

1. Field of the Invention

This invention relates generally to rapidly solidified copper-rich metal alloys which include certain specific amounts of boron. This invention also relates to the preparation of these materials in the form of rapidly solidified powder and consolidation of these powders (or alternatively the rapidly solidified ribbonlike material) into bulk parts which are suitably heat treated to have certain desirable properties.

2. Description of the Prior Art

Rapid solidification processing (RSP) techniques offer outstanding prospects of new, cost effective engineering materials with superior properties. [See Proc. Int. Conf. on Rapid Solidification Porcessing; Reston, VA, 1980; Published by Claitors Publishing Division, Baton Rouge, LA]. Metallic glasses, microcrystalline alloys, supersaturated solid solutions, and ultrafine grained alloys with highly refined microstructures, in each case often having complete chemical homogeneity, are some of the products that can be made utilizing RSP [see Rapidly Quenched Metals, 3rd Int. Conf. Vol. 1 and 2, Cantor, Ed., The Metals Society, London, 1978.]

Several techniques are well established in the state of the art to economically fabricate rapidly solidified alloys (at cooling rates of $\sim 10^{5°}$ to $10^{7°}$ C./sec) as ribbons, filaments, wire, flakes or powders in large quantities. One well known example is melt spin chill casting, whereby the melt is spread as a thin layer on a conductive metallic substrate moving at high speed to form a rapidly solidified ribbon. [See Proc. Int. Conf. on Rapid Solidification Processing, Reston Va., Nov. 1977].

The current technological interest in materials produced by RSP, especially when followed by consolidation into bulk parts, may be traced in part to the problems associated with micro and macro segregation and undesirable massive grain boundary eutectic phases that occur in highly alloyed materials during conventional slow cooling processes i.e. ingot or mold casting. RSP removes macro-segregation altogether and significantly reduces spacing over which micro-segregation occurs, if it occurs at all. The design of alloys made by conventional slow cooling process is largely influenced by the corresponding equilibrium phase diagrams which indicate the existence and co-existence of the phases present in thermodynamic equilibrium. The advent of rapid quenching from the melt has enabled material scientists to stray further from the state of equilibrium and has greatly widened the range of new alloys with unique structures and properties available for technological applications.

Many copper alloys are specified for services where superior corrosion resistance, electrical conductivity, good bearing surface quality and fatigue characteristics are required. In addition, it has a pleasing color, is nonmagnetic and is easily finished by plating or lacquering. These alloys also can be easily welded, brazed or soldered. [See source book on Materials Selection, Vol, II, American Society of Metals, Ohio, 1977, Section VII-195 and 207].

Copper base alloys containing 10 to 30 wt. % nickel which are commercially known as cupro-nickel are widely used in a variety of applications e.g. condensers, condenser plates, distiller tubing, heat exchangers, electrical springs, relays, etc. due to excellent hot and cold workability, good mechanical properties and excellent corrosion resistance.

There has been limited effort, as reported in the prior art involving use of rapid solidification processing techniques, to synthesise new and improved copper base alloys. A need therefore exists to develop new copper base alloys with unique chemical compositions and structures exhibiting superior mechanical properties, corrosion and/or oxidation resistance for numerous engineering applications.

SUMMARY OF THE INVENTION

This invention features a class of copper base alloys having excellent corrosion and oxidation resistance combined with high hardness and high strength when the production of these alloys includes a rapid solidification process. These alloys can be described by the following composition, $Cu_aNi_bAl_cCr_dM_eB_fSi_g$-[A]-wherein Cu, Ni, Al, Cr, B and Si respectively represent copper, nickel, aluminum, chromium, boron and silicon, M is one or more of the metals iron (Fe), cobalt (Co), vanadium (V) and manganese (Mn), a, b, c, d, e, f and g represent atom percent of Cu, Ni, Al, Cr, M, B and Si respectively and have the following values a=30–83, b=10–45, c=0–20, d=0–20, e=0–10, f=3–20 and g=0–5 (in weight percent a=40–87, b=10–45, c=0–10, d=0–18, e=0–8, f=5–4 and g=0–2.5) with the provisos that (1) the sum of (b+c+d+e) may not exceed 65 atom percent (56weight percent), (2) the sum of (c+d) may not exceed 30 atom percent (22.5 weight percent) and (3) the sum of (a+b+c+d+e+f+g) is 100. By way of reference all compositions disclosed herein are in atom percent unless otherwise specified.

Rapid solidification processing (RSP) [i.e. processing in which the liquid alloy is subjected to cooling rates of the order of $10^{5°}$ to $10^{7°}$ C./sec] of such boron-containing alloys produced a metastable crystalline structure which is chemically homogeneous and can be heat treated and/or thermomechanically processed so as to form fine dispersions of borides and/or silicides which strengthen the alloy as well as other intermetallics. The heat treated and/or thermomechanically processed material is harder and stronger than conventional alloys while exhibiting excellent corrosion and oxidation resistance. The inclusion of boron in the alloy has several advantages. It enchances the supercooling of liquid which is achievable and makes easier the formation of a chemically homogeneous, metastable crystalline product when a RSP is used. The fine borides and/or silicides formed in RSP alloy after heat treatment strengthen the metal and enhance microstructural stability and strength. The inclusion of boron makes it possible to obtain a good yield of uniform material from melt spinning which is an economical RSP. The as-quenched melt spun ribbons are brittle and can be readily ground to a powder, a form especially suitable for consolidation into a transformed (ductile) final porduct. The melt spinning method includes any of the procedures like single roll chill block casting, double roll quenching, melt extraction, melt drag, etc. where a thin layer of liquid metal is brought in contact with a solid substrate.

DETAILED DESCRIPTION OF THE PREFERRED EMBODIMENTS

In accordance with the present invention, copper base alloys containing 10 to 45% (10–45 wt. %) of nickel is further alloyed with 3 to 20% (0.5–4 wt. %) of boron. These alloys are optionally alloyed with one or more of the following elements: 0 to 20% (0–10 wt. %) of Al, 0 to 20% (0–18 wt. %) of Cr, 0 to 5% (0–2.5 wt. %) of Si and 0 to 10% (0–18 wt. %) of Fe, Co, V and Mn as single or combined. The alloys may also contain limited amounts of other elements which are found in commercial copper base alloys without changing the essential behavior of the alloys. Typical examples include: $Cu_{66}Ni_{17}B_{17}$, $Cu_{68}Ni_{10}Al_{10}B_{12}$, $Cu_{59}Ni_{13}B_{13}Cr_{15}$, $Cu_{67}Ni_{10}Al_5B_8Cr_{10}$ and $Cu_{54}Ni_{10}Al_{15}Cr_{15}Fe_3B_3$ *(or in weight percent respectively,* $Cu_{78}Ni_{18.6}B_{3.4}$, $Cu_{81.4}Ni_{11}Al_{5.1}B_{2.5}$, $Cu_{69}Ni_{14}B_{2.6}Cr_{14.4}$, $Cu_{76.2}Ni_{10.6}Al_{2.4}B_{1.5}Cr_{9.3}$, and $Cu_{63.5}Ni_{10.9}Al_{7.5}Cr_{14.5}Fe_3B_{0.6}$).

The alloys of the present invention, upon rapid solidification processing from the melt by melt spin chill casting at cooling rates of the order of $10^{5°}$ to $10^{7°}$ C./sec., form brittle ribbons consisting predominantly of solid solution phase with high degree of compositional uniformity. The brittle ribbons are readily pulverized into staple or powder configuration using standard comminution techniques. The powder or staple is consolidated into bulk parts using standard powder metallurgical techniques optionally followed by heat treatments for optimised properties. The bulk alloys contain finly dispersed intermetallic compounds and borides and/or silicides within the conventional copper-rich matrix, such material being ductile and having high hardness and strength compared to commercial copper-nickel alloys.

When the alloys within the scope of the present invention are solidified by conventional slow cooling processes, they inherent highly segregated microstructures with large compositional nonuniformity and large eutectic network of brittle boride phases and, hence, exhibit poor mechanical properties. In contrast, when the above alloys are RSP processed followed by heat treatment at high temperatures, preferably between 700° to 950° C. for 0.1 to 100 hours, the precipitation of ultrafine complex metallic borides such as MB, $M_2B$, $M_6B$, etc. takes place where M is one or more of the metals in the alloys, these boride particles with average particles size of $\sim 0.5\mu$, preferably 0.05 micron, being finely dispersed both intergranularly and intragranularly. Typically, the matrix grains have size less than 10 microns, preferably less than 2 microns. The high temperature heat treatment necessary to generate the above microstructures of the alloys of the present invention can be a separate annealing treatment or can occur along with the consolidation step. Consolidation can also be achieved by hot mechanical deformation at high strain rate whereby finer boride particles will precipitate out in the matrix.

The fully heat treated RSP alloys of the present invention exhibit high strength and high hardness combined with good ductility as compared to commercially known copper-nickel alloys. The alloys of the present invention typically have hardness values of 140 to 550 $Kg/mm^2$ and tensile strengths of 60 to 300 Ksi. As a comparison, the commercial copper-nickel alloys have significantly low hardness values between 100 and 200 $Kg/mm^2$ and ultimate tensile strengths between 45 to 90 Ksi.

The invention includes preparation of rapidly solidified powders of the present boron-containing copper-rich alloys by melt spin chill casting of brittle ribbon followed by mechanical pulverisation of ribbons. Other known rapid solidification powder processing methods, such as forced convective cooling of atomised droplets, known in the art, can be used to fabricate RSP powders of the present alloys and such powders can be subsequently powder metallurgically consolidated into bulk parts and/or heat treated for optimised microstructures, mechanical properties and corrosion and oxidation resistance. RSP powders of the present alloys, either made from ribbon or directly from the melt or the filaments can be consolidated into bulk parts i.e. bars, rods, plates, discs, ingots etc. by various known metallurgical processing techniques such as hot extrusion, hot forging, hot isostatic pressing, hot rolling, cold pressing followed by sintering, etc.

While any of the wide variety of RSP techniques can be employed in the practice of this invention, the combination of melt spinning and subsequent pulverization is preferred. The quench rate experienced by the melt is much more uniform in the melt spinning process than for e.g. atomization processes. In atomization, the quench rate and hence the metastable structure and the final heat treated structure derived therefrom varies greatly with the particle size. Screening out the larger particles formed from atomization gives material which has been subjected to a more uniform quench. However, the yield is reduced making the process less economical. In contrast, the powders made from pulverised ribbons have experienced the same quench history. The melt-spinning procedure can be practiced with the present alloys so to have a high yield (e.g. >95%) of relatively fine powder (e.g. −100 mesh). Alternatively, the rapidly solidified filaments, as-formed or after partial fragmentation, can be consolidated directly into bulk parts without the step necessary to form an intermediate powder. The boron content of the present alloys in the range 3 to 20 atom percent (5–4wt. %) is critical. When boron content is less than 3 atom percent (0.5 wt. %), the copper base alloys are difficult to form as rapidly solidified brittle ribbons by the method of melt deposition on a rotating chill substrate i.e. melt spinning. This is due to the inability of the boron-lean alloy melts to form a stable molten pool on the quench surface. Furthermore, at very low boron content the alloys have less desirable mechanical properties in the heat treated condition beacause of having insufficient amounts of the strengthening borides that can be formed by the heat treatment. Thus, more than 3% (0.5 wt. %) boron is desirable.

When the boron content is high, i.e. >20% (4 wt. %), the heat treated alloys exhibit poor mechanical properties i.e. low strength and high degree of brittleness, due to excessive amounts of hard and brittle boride particles in the microstructure. Thus, less than 20% (4 wt. %) boron is desirable.

The rapidly solidified brittle ribbons fabricated by melt spinning can be mechanically comminuted into powders having a particle size less than 100 U.S. mesh using standard equipment such as hammer mill, ball mill, fluid energy mill and the like. The physical properties of the heat treated alloys depend on alloy compositions and the heat treatment cycles employed. Thus, a specific property can be optimised by identifying those alloying elements and the degree of alloying which optimise that property. Of particularly interest in these alloys, are increased strength and hardness and improved oxidation and corrosion resistance. The alloys of the present invention will find numerous practical applications such as parts for condensers, heat exchangers, salt water pipes, high strength parts, sea water corrosion resistance, electrical springs, architectural and constructional parts with atmospheric corrosion resistance. etc.

The alloys of the system Cu-Ni-B with B contents 8 to 17% (1.5–3.5 wt. %) prepared in accordance with the present invention belong to a preferred group of alloys. These alloys are described by the formula $Cu_{43-77}Ni_{15-40}B_{8-17}$. Examples include $Cu_{66}Ni_{17}B_{17}$, $Cu_{56}Ni_{30}B_{14}$, $Cu_{46}Ni_{40}B_{14}$, $Cu_{6}Ni_{0}B_{10}$, and $Cu_{48}Ni_{40}B_{12}$(or in weight percent respectively, $Cu_{52.5-83.5}Ni_{15-44}B_{1.5-3.5}$, $Cu_{78-}Ni_{18.6}B_{3.4}$, $Cu_{65}Ni_{32.2}B_{2.8}$, $Cu_{53.9}Ni_{43.3}B_{2.8}$, $Cu_{69.-1}Ni_{29}B_{1.9}$ and $Cu_{55.2}Ni_{42.5}B_{2.3}$). The above alloys upon rapid quenching by melt spinning form extremely brittle ribbons consisting of single solid solution phase. The quenched alloys may additionally contain borides dispersed in the matrix. Upon heat treatment between 750° and 900° C. for 1 to 3 hours the precipitation of ultrafine complex borides takes place both intragranularly and intergranularly. After such heat treatment the above Cu-Ni-B alloys become ductile and posses relatively high hardness values between 150 and 490 Kg/mm$^2$.

Another preferred class of alloys is based on the system Cu-Ni-Al-B. This class is defined by the general formula $Cu_{50-78}Ni_{10-20}Al_{2-15}B_{10-15}$. Examples include $Cu_{73}Ni_{12}Al_{3}B_{12}$, $Cu_{71}Ni_{15}Al_{2}B_{12}$, $Cu_{68}Ni_{10}Al_{10}B_{12}$, $Cu_{70}Ni_{10}Al_{5}B_{15}$, and $Cu_{65}Ni_{10}Al_{15}B_{10}$ (or in weight percent respectively, $Cu_{64.5-86.6}Ni_{10.5-24}Al_{1-8.2}B_{1.9-3.3}$, $Cu_{83.5}Ni_{12.7}Al_{1.5}B_{2.3}$, $Cu_{80.9}Ni_{15.8}Al_{1}B_{2.3}$, $Cu_{81.4}Ni_{1-1}Al_{5.1}B_{2.5}$, $Cu_{83.4}Ni_{11}Al_{2.5}B_{3.1}$ and $Cu_{79}Ni_{11.2}Al_{7.7}B_{2.1}$).

The ribbons obtained by melt spinning are brittle which upon heat treatment above 750° C. becomes ductile and hard with typical hardness values ranging from 150 to 300 Kg/mm$^2$.

Another preferred class of alloys which is obtained by the addition of chromium to Cu-Ni-B alloy is described by the formula $Cu_{55-80}Ni_{10-20}B_{8-20}Cr_{5-20}$. Typical examples include $Cu_{59}Ni_{13}B_{13}Cr_{15}$, $Cu_{58}Ni_{17}B_{17}Cr_{8}$ and $Cu_{56}Ni_{17}B_{17}Cr_{10}$ (or in wt. % respectively, $Cu_{65-85-}Ni_{12.5-24}B_{1.5-4}Cr_{4.5-18}$, $Cu_{69}Ni_{14}B_{2.6}Cr_{14.4}$, $Cu_{69.-7}Ni_{19}B_{3.5}Cr_{7.8}$and $Cu_{67.6}Ni_{19}B_{3.4}Cr_{10}$).

The above alloys when processed by the method described in the present invention exhibit very high hardness, up to ~500 Kg/mm$^2$, and hence high tensile strength. The solid solubility of Cr in Cu is low and hence the alloys upon being processed by the conventional techniques show a high degree of chemical segregation. In contrast, when these alloys are rapidly solidified and heat treated they contain uniformly dispersed borides and chromium possessing good mechanical properties and excellent corrosion resistance.

One other preferred system is given by the formula $Cu_{45-78}Ni_{10-20}Al_{1-15}Cr_{5-15}Fe_{0-3}B_{3-17}$. Examples include $Cu_{67}Ni_{10}Al_{5}B_{8}Cr_{10}$, $Cu_{60}Ni_{10}Al_{10}B_{10}Cr_{10}$, $Cu_{59-}Ni_{10}Al_{15}B_{3}Fe_{3}Cr_{10}$, $Cu_{54}Ni_{10}Al_{15}B_{3}Fe_{3}Cr_{15}$ and $Cu_{57-}Ni_{15}Al_{8}B_{10}Cr_{10}$ (or in wt. % respectively, $Cu_{62-87}Ni_{10-.5-24}Al_{0.5-7.5}Cr_{4.5-15}Fe_{0-3}B_{0.5-3.6}$, $Cu_{76.2}Ni_{10-.5}Al_{2.4}B_{1.6}Cr_{9.3}$, $Cu_{72}Ni_{11.1}Al_{5.1}B_{2}Cr_{9.8}$, $Cu_{68.7}Ni_{10-.7}Al_{7.4}B_{0.3}Fe_{3}Cr_{9.6}$, $Cu_{63.5}Ni_{10.9}Al_{7.5}B_{0.6}Fe_{3}Cr_{14.5}$ and $Cu_{67.7}Ni_{16.5}Al_{4}B_{2.1}Cr_{9.7}$).

The above alloys form brittle ribbons when rapidly solidified by melt spinning. Subsequent heat treatment above 750° C. transforms the ribbon into a fully ductile state having hardness values ranging between 140 to 375 Kg/mm$^2$.

For the above alloys the dominant mechanism of strengthening is dispersion hardening. To achieve the most effective dispersion hardening, the boride particles must be very small and the distribution must be uniform.

All the above alloys described as preferred class exhibit good atmospheric corrosion resistance when exposed in an outdoor environment. They also exhibit nearly the same or better corrosion resistance than the conventional Cu-Ni alloys while possessing significantly superior mechanical properties.

The alloys were exposed in natural surroundings. They retained their lustre without showing any effect of corrosion. Also, the alloys containing aluminum were resistant to corrosion in 5 Wt. % sodium chloride solution and also had good oxidation resistance.

EXAMPLES 1 to 9

Selected copper-nickel alloys were alloyed with various boron contents ranging from 8 to 17% (1.5–3.5 wt. %) (Table 1). These boron-containing alloys were melt spun into ribbons having thicknesses of 25 to 75 microns thick by RSP method of melt spinning using a rotating Cu-Be cylinder having a quench surface speed of ~5000 ft/min. The ribbons were found by X-ray diffraction analysis to consist predominantly of a single solid solution phase. Ductility of the ribbons was measured by the bend test. The ribbon was bent to form a loop and the diameter of the loop was gradually reduced until the loop was fractured. The breaking diameter of the loop is a measure of ductility. The larger the breaking diameter for a given ribbon thickness, the more brittle the ribbon is considered to be, (i.e.) the less ductile. The asquenched ribbons were all found to have breaking diameters of ~0.1 inch and thus are quite brittle. The ribbons were heat treated at 750°/900° C. for 2 hours and then air cooled to room temperature. The ribbons were found to be fully ductile. A ribbon which bends back onto itself without breaking has deformed plastically into a 'V' shape and is labelled fully ductile. The hardness values of these ribbons ranged between 150 to 490 Kg/mm$^2$.

TABLE 1

| Example | Alloy Composition (atom percent) | Hardness Kg/mm$^2$ |
|---|---|---|
| 1 | $Cu_{66}Ni_{17}B_{17}$ | 490 |
| 2 | $Cu_{60}Ni_{30}B_{10}$ | 210 |
| 3 | $Cu_{50}Ni_{40}B_{10}$ | 230 |
| 4 | $Cu_{58}Ni_{30}B_{12}$ | 150 |
| 5 | $Cu_{48}Ni_{40}B_{12}$ | 320 |
| 6 | $Cu_{56}Ni_{30}B_{14}$ | 300 |
| 7 | $Cu_{54}Ni_{30}B_{16}$ | 320 |
| 8 | $Cu_{44}Ni_{40}B_{16}$ | 345 |
| 9 | $Cu_{67}Ni_{25}B_{8}$ | 300 |

EXAMPLES 10 TO 17

Several copper-nickel-aluminum alloys containing boron were melt spun as RSP ribbons in 60 to 100 gms quantity as detailed above. The compositions of the alloys are given in Table 2. The as-cast ribbons were found to be brittle to bending and were readily pulverised into powders under 100 mesh using a commercial rotating hammer mill. The as-quenched ribbon samples of the above alloys upon heat treatment at 760° C. for 2 hours were found to become fully ductile to 180° bending. The heat treated ribbons exhibited hardness values between 150 and 300 Kg/mm$^2$.

TABLE 2

| Example | Alloy Composition (atom percent) | Hardness Kg/mm$^2$ |
|---|---|---|
| 10 | $Cu_{73}Ni_{12}Al_3B_{12}$ | 150 |
| 11 | $Cu_{71}Ni_{15}Al_2B_{12}$ | 215 |
| 12 | $Cu_{65}Ni_{10}Al_{15}B_{10}$ | 280 |
| 13 | $Cu_{70}Ni_{10}Al_{15}B_{10}$ | 250 |
| 14 | $Cu_{73}Ni_{10}Al_5B_{12}$ | 185 |
| 15 | $Cu_{68}Ni_{10}Al_{10}B_{12}$ | 285 |
| 16 | $Cu_{70}Ni_{10}Al_5B_{15}$ | 215 |
| 17 | $Cu_{66}Ni_{20}Al_2B_{12}$ | 300 |

EXAMPLES 18 and 19

A number of copper-nickel-chromium alloys containing boron were prepared as RSP ribbons in 50 to 100 gms quantity in accordance with the present invention. The typical compositions of two alloys are given in Table 3. The melt spun ribbons were found to be brittle to permit ready pulverization into powder under 100 mesh. Upon heat treatment at 760° C. for 2 hours, the melt spun ribbons became fully ductile and had hardness values between 220 to 500 Kg/mm$^2$.

TABLE 3

| Example | Alloy Composition (atom percent) | Hardness Kg/mm$^2$ |
|---|---|---|
| 18 | $Cu_{59}Ni_{13}B_{13}Cr_{15}$ | 500 |
| 19 | $Cu_{58}Ni_{17}B_{17}Cr_8$ | 225 |

EXAMPLES 20 to 28

In accordance with the present invention Cu-Ni-Al-Cr alloys containing boron and/or iron were melt spun into brittle ribbons. The as-cast ribbons of the said alloys become ductile after heat treatment at 760° C. for 2 hours. The compositions are given in Table 4. The hardness values after heat treatment range from 140 to 375 Kg/mm$^2$.

TABLE 4

| Example | Alloy Composition (atom percent) | Hardness Kg/mm$^2$ |
|---|---|---|
| 20 | $Cu_{60}Ni_{10}Al_{10}Cr_{10}B_{10}$ | 375 |
| 21 | $Cu_{57}Ni_{15}Al_8Cr_{10}B_{10}$ | 300 |
| 22 | $Cu_{60}Ni_{10}Al_7Cr_{15}B_8$ | 330 |
| 23 | $Cu_{54}Ni_{17}Al_2Cr_{10}B_{17}$ | 240 |
| 24 | $Cu_{55}Ni_{17}Al_1Cr_{10}B_{17}$ | 220 |
| 25 | $Cu_{59}Ni_{10}Al_{15}Cr_{10}B_3Fe_3$ | 290 |
| 26 | $Cu_{54}Ni_{10}Al_{15}Cr_{15}B_3Fe_3$ | 310 |
| 27 | $Cu_{69}Ni_{10}Al_5Cr_{10}B_3Fe_3$ | 300 |
| 28 | $Cu_{60}Ni_{12}Al_3Cr_{15}B_{10}$ | 140 |

EXAMPLES 29 to 33

The following alloys (refer Table 5) were exposed in an indoor atmospheric environment for 1500 hours. All the alloys were found to exhibit excellent resistance to indoor atmospheric corrosion (i.e.) the alloys showed no sign of discoloration or tarnish.

TABLE 5

| Example | Alloy Composition (atom percent) |
|---|---|
| 29 | $Cu_{59}Ni_{13}B_{13}Cr_{15}$ |
| 30 | $Cu_{54}Ni_{17}Al_2Cr_{10}B_{17}$ |
| 31 | $Cu_{66}Ni_{17}B_{17}$ |
| 32 | $Cu_{60}Ni_{12}Al_3Cr_{15}B_{10}$ |

TABLE 5-continued

| Example | Alloy Composition (atom percent) |
|---|---|
| 33 | $Cu_{70}Ni_{10}Al_{10}B_{10}$ |

EXAMPLES 34 to 36

The following alloys (refer Table 6) were exposed to outdoor atmospheric environment for 1500 hours. The alloys were found to show excellent resistance to outdoor atmospheric corrosion (i.e.) the alloys showed no sign of discoloration or tarnish.

TABLE 6

| Example | Alloy Composition (atom percent) |
|---|---|
| 34 | $Cu_{57}Ni_{15}Al_8Cr_{10}B_{10}$ |
| 35 | $Cu_{70}Ni_{10}Al_{10}B_{10}$ |
| 36 | $Cu_{68}Ni_{10}Al_{10}B_{12}$ |

EXAMPLES 37 to 39

The following alloys (refer Table 7) were exposed at a temperature of 760° C. for 16 hours. They did not show any trace of oxidation as evidenced by the lack of oxide scale formation.

TABLE 7

| Example | Alloy Composition (atom percent) |
|---|---|
| 37 | $Cu_{57}Ni_{15}Al_8Cr_{10}B_{10}$ |
| 38 | $Cu_{68}Ni_{10}Al_{10}B_{12}$ |
| 39 | $Cu_{60}Ni_{10}Al_7Cr_{15}B_8$ |

EXAMPLES 40 and 41

The following alloys (refer Table 8) were kept in 5 wt % sodium chloride solution for 120 hours. They did not show any corrosion as evidenced by the clear surface.

TABLE 8

| Example | Alloy Composition (atom percent) |
|---|---|
| 40 | $Cu_{70}Ni_{10}Al_{10}B_{10}$ |
| 41 | $Cu_{68}Ni_{10}Al_{10}B_{12}$ |

EXAMPLE 42

The alloy of the following composition (refer Table 9) was melt spun into brittle ribbons as detailed above. It was pulverised in a standard hammer mill to fine powder (−100 mesh) and 250 gms of the powder was produced.

TABLE 9

| Example | Alloy Composition (atom percent) |
|---|---|
| 42 | $Cu_{70}Ni_{15}B_{15}$ |

EXAMPLE 43

The following example illustrates an economical method of continuous production of RSP powder of the boron modified copper base alloys of the composition indicated in (A) with the present invention.

The copper base alloys containing boron are melted in any of the standard melting furnaces. The melt is transferred via a ladle into a tundish having a series of orifices. A multiple number of jets are allowed to impinge on a rotating water cooled copper-beryllium drum whereby the melt is rapidly solidified as ribbons. The as-cast brittle ribbons are directly fed into a hammer mill of appropriate capacity wherein the ribbons are ground into powders of desirable size ranges.

| Example | Composition wt % |
|---|---|
| 1 | $Cu_{78}Ni_{18.6}B_{3.4}$ |
| 2 | $Cu_{67.1}Ni_{31}B_{1.9}$ |
| 3 | $Cu_{56.4}Ni_{41.7}B_{1.9}$ |
| 4 | $Cu_{66.1}Ni_{31.6}B_{2.3}$ |
| 5 | $Cu_{55.2}Ni_{42.5}B_{23}$ |
| 6 | $Cu_{65}Ni_{32.2}B_{2.8}$ |
| 7 | $Cu_{64}Ni_{32.8}B_{3.2}$ |
| 8 | $Cu_{52.7}Ni_{44}B_{3.3}$ |
| 9 | $Cu_{73.2}Ni_{25.2}B_{1.6}$ |
| 10 | $Cu_{83.5}Ni_{12.7}Al_{1.5}B_{2.3}$ |
| 11 | $Cu_{80.9}Ni_{15.8}Al_{1}B_{2.3}$ |
| 12 | $Cu_{79}Ni_{11.2}Al_{7.7}B_{2.1}$ |
| 13 | $Cu_{82.2}Ni_{10.8}Al_{5}B_{2}$ |
| 14 | $Cu_{84.5}Ni_{10.7}Al_{2.4}B_{2.4}$ |
| 15 | $Cu_{81.4}Ni_{11}Al_{5.1}B_{2.5}$ |
| 16 | $Cu_{83.4}Ni_{11}Al_{2.5}B_{3.1}$ |
| 17 | $Cu_{75.5}Ni_{21}Al_{1}B_{2.5}$ |
| 18 | $Cu_{69}Ni_{14}Cr_{14.4}B_{2.6}$ |
| 19 | $Cu_{69.7}Ni_{19}Cr_{7.8}B_{3.5}$ |
| 20 | $Cu_{72}Ni_{11.1}Al_{5.1}Cr_{9.8}B_{2}$ |
| 21 | $Cu_{67.7}Ni_{16.5}Al_{4}Cr_{9.7}B_{2.1}$ |
| 22 | $Cu_{69.9}Ni_{10.8}Al_{3.5}Cr_{14.2}B_{1.6}$ |
| 23 | $Cu_{66.2}Ni_{19.2}Al_{1}Cr_{11}B_{3.6}$ |
| 24 | $Cu_{66.9}Ni_{19.1}Al_{0.5}Cr_{10}B_{3.5}$ |
| 25 | $Cu_{68.7}Ni_{10.7}Al_{7.4}Cr_{9.6}B_{.6}Fe_{3}$ |
| 26 | $Cu_{63.5}Ni_{10.9}Al_{7.5}Cr_{14.5}B_{.6}Fe_{3}$ |
| 27 | $Cu_{75.2}Ni_{10.1}Al_{2.3}Cr_{8.9}B_{.6}Fe_{2.9}$ |
| 28 | $Cu_{69.5}Ni_{12.9}Al_{1.5}Cr_{14.2}B_{1.9}$ |
| 29 | Same as 18 |
| 30 | Same as 23 |
| 31 | Same as 1 |
| 32 | $Cu_{69.5}Ni_{12.9}Al_{1.5}Cr_{14.2}B_{1.9}$ |
| 33 | Same as 13 |
| 34 | Same as 21 |
| 35 | Same as 13 |
| 36 | Same as 15 |
| 37 | Same as 21 |
| 38 | Same as 15 |
| 39 | Same as 22 |
| 40 | Same as 13 |
| 41 | Same as 15 |

-continued

| Example | Composition wt % |
|---|---|
| 42 | $Cu_{81}Ni_{16}B_{3}$ |

Having thus described the invention, what we claim and desired to obtain by Letters Patent of the United States is:

1. Fine grained Copper-Nickel alloys containing borides in bulk form having composition $Cu_aNi_bAl_cCr_dM_eB_f$; wherein Cu, Ni, Al, Cr, and B are copper, nickel, aluminum, chromium and boron respectively, and M represents one or more of iron (Fe), cobalt (Co), vanadium (V), and manganese Mn) and wherein a, b, c, d, e and f represent weight percent of Cu, Ni, Al, Cr, M and B respectively and having the following values: a=40–87, b=10.5–44, c=0–10, d=0–18, e=0–8, f=1.5–4 wherein the maximum value of b+c+d+e may not exceed 56, the maximum value of c+d may not exceed 22.5 and the sum of a+b+c+d+e+f=100, made by subjecting the powders of the said alloy by application of pressure and heat, said powders being made by the method comprising the following steps:

(a) forming a melt of said alloy (b) depositing said melt against a rapidly moving quench surface adapted to quench said melt at a rate in the range of approximately $10^5$ to $10^{7°}$ C./second and form thereby a rapidly solidified brittle strip of said alloys characterized by predominantly a single solid solution structure, (c) comminuting said strip into powders.

2. An alloy of claim 1 having the composition $Cu_{52.5-83.5}Ni_{15-44}B_{1.5-3.5}$ wherein the subscripts are in weight percent.

3. An alloy of claim 1 having the composition $Cu_{64.5-86.6}Ni_{10.5-24}Al_{1-8.2}B_{1.9-3.3}$, wherein subscripts are in weight percent.

4. An alloy of claim 1 having composition $Cu_{65-85}Ni_{12.5-24}Cr_{4.5-18}B_{1.5-4}$ wherein subscripts are in weight percent and the sum of weight percent of Cu, Ni, Cr and B is 100.

5. An alloy of claim 1 having the composition $Cu_{65-87}Ni_{10.5-24}Al_{0.5-7.5}Cr_{4.5-15}B_{1.6-3.6}$ wherein subscripts are in weight percent and the sum of weight percent of Cu, Ni, Al, Cr, and B is 100.

* * * * *